US005666872A

United States Patent [19]

McDonald et al.

[11] Patent Number: 5,666,872

[45] Date of Patent: Sep. 16, 1997

[54] ROTARY FOAM CUTTER FOR TAPERING INSULATION

[76] Inventors: Kevin McDonald, 401 Fort St.; Douglas A. McDonald, 1729 Delaware Ct., both of Defiance, Ohio 43512; Jerold C. Gardner, 4415 Sheratin Rd., Toledo, Ohio 43615-2269

[21] Appl. No.: 437,950

[22] Filed: May 9, 1995

[51] Int. Cl.[6] ..... B26F 3/12

[52] U.S. Cl. ..... 83/871; 83/171; 83/651.1; 83/811; 83/813

[58] Field of Search ..... 83/171, 651.1, 83/16, 810, 811, 812, 813, 871, 796; 264/138, 145, 157, 158, 321; 219/68, 69.12, 469, 470, 471, 216

[56] References Cited

U.S. PATENT DOCUMENTS

| | | | |
|---|---|---|---|
| 3,203 | 10/1843 | Western et al. | 83/811 |
| 2,972,669 | 2/1961 | Brown | 83/171 |
| 3,064,111 | 11/1962 | Newman | 83/171 |
| 3,097,557 | 7/1963 | Langstaff . | |
| 3,199,388 | 8/1965 | Redfield | 83/171 |
| 3,895,438 | 7/1975 | Burkepile et al. . | |
| 4,479,045 | 10/1984 | Inoue | 219/69.12 |
| 4,536,145 | 8/1985 | Sawyer et al. . | |
| 4,608,893 | 9/1986 | Huhne | 83/651.1 |
| 4,779,497 | 10/1988 | Lee . | |
| 4,850,844 | 7/1989 | Hunting | 83/171 |
| 5,429,163 | 7/1995 | Frenkel et al. | 83/16 |

FOREIGN PATENT DOCUMENTS

| | | | |
|---|---|---|---|
| 79596 | 2/1868 | France | 83/813 |
| 3046643 | 7/1982 | Germany | 83/171 |
| 1278128 | 12/1996 | Russian Federation | 83/651.1 |
| 2526423 | 10/1950 | United Kingdom | 219/69.12 |

*Primary Examiner*—Rinaldi I. Rada
*Assistant Examiner*—David John Kalil
*Attorney, Agent, or Firm*—Marshall & Melhorn

[57] ABSTRACT

A tapering apparatus is mounted on a table platform for tapering a sheet of foam insulation. The apparatus utilizes a rotating wire through which a current is applied in order to heat the wire. The temperature of the wire is maintained above the melting temperature of the foam insulation so that the insulation is melt and cut as it is forced across the wire. A conductive wire forms an endless belt positioned around a pair of rotatable sheaves. The wire is responsive to the angular rotation of the drive sheave. The sheaves are vertically adjustable in order to set a desired height and cutting angle for the tapering of the sheet of insulation. The current flowing through the wire is controlled such that the wire is heated to a temperature above the melting point of the foam insulation. A variable speed motor is connected to the drive sheave which is used to rotate the wire about the sheaves. The sheet of foam insulation is then forced into the rotating wire. The heat and rotation of the wire evenly melts the insulation and tapers the foam insulation sheet as it is forced across the wire.

13 Claims, 4 Drawing Sheets

ROTARY FOAM CUTTER FOR TAPERING INSULATION

BACKGROUND OF THE INVENTION

1. Field of the Invention

This invention relates to an apparatus for tapering sheets of foam insulation. More particularly, this invention relates to an apparatus for tapering sheets of foam insulation which utilizes a rotating wire heated above the melting temperature of the foam insulation to remove a section of insulation from the sheet. The heated wire maintains a generally uniform temperature across the section of the wire in contact with the insulation to evenly melt and cut the foam insulation at the desired angle as the insulation is forced across the wire.

2. Summary of Related Art

The roofing process for flat roof applications requires the placement of sheets of foam insulation onto the roof prior to applying the sealing materials. The insulation must be sloped in the appropriate manner so that the water drains correctly. Therefore, the sheets of insulation must be tapered horizontally to obtain the appropriate pitch in the roof. The sheets of insulation must be cut to create this horizontal slope.

The known tapering equipment currently in use provides a heated wire which is maintained in a taut condition as the insulation is continuously forced against the wire. The heat from the wire melts the insulation in the desired cutting path. The process is limited by the speed at which the insulation can be forced around the heated wire. The melting process is preferred over a cutting process because of the difficulty in cutting the insulation to form a smooth surface.

One of the problems which frequently occurs with tapering equipment is that the heated wire has the tendency to break. The speed of the tapering process is increased by using a high temperature wire with more force in driving the insulation across the heated wire. The heat dissipation along the length of the wire is uneven, with the wire being hotter at the edges of the insulation and cooler at the center portion of the insulation. The breakage typically occurs at the middle of the wire strand. The cooler middle wire segment cannot melt the insulation as fast as the hotter end segments. As force is applied to move the insulation, tension in the slower melting center segment builds up until the wire breaks.

The breakage and subsequent replacement of the wire on the tapering equipment can create a significant amount of downtime, which results in an ineffective use of the tapering equipment and additional costs for a roofing project.

Another problem which can occur in using a heated wire to taper the sheet of insulation is that the wire reaches a temperature that will burn the insulation. Because of the problems with burning insulation, the possibility of increasing the production rate for tapering the sheet of insulation by raising the temperature of the wire is limited. The temperature limitations using a heated wire to melt the insulation results in a very slow process for tapering the sheets of insulation.

U.S. Pat. No. 4,536,145 to Sawyer, et. al. discloses an apparatus for cutting a contoured surface in the face of a polystyrene foam block. The apparatus utilizes a heated wire to cut through the foam block. The wire is static and therefore subject to uneven heating and subsequent breakage.

U.S. Pat. No. 4,779,497 to Lee shows an apparatus for removing excess masking film from the outer periphery of a silicon wafer. The apparatus continuously feeds a heated wire and an unheated wire which contact the excess masking film and trims it from the silicon wafer. The invention utilizes a rotating table that holds the silicon wafer and moves it into the wires. The thin film is first cut by the heated wire and then trimmed off by the unheated wire.

U.S. Pat. No. 4,850,844 to Hunting discloses an apparatus for tapering plastic shingles. The apparatus utilizes at least one heated wire that is transversely mounted across the path of a moving shingle. The wire is static with one end adjustable to vary the angle of the cut across the shingle.

In the roofing industry, there is a need for a faster and more efficient means for tapering sheets of insulation. Another concern in the tapering equipment is to reduce the time and expense of wire replacement, which could be addressed by a wire with an extended life.

SUMMARY OF THE INVENTION

In accordance with the present invention, there is provided a tapering apparatus mounted on a table platform for tapering a sheet of foam insulation. The apparatus utilizes a continuous loop of wire which is heated by an electrical current and which is moved around two rotatable sheaves. The temperature of the wire is maintained above the melting temperature of the foam insulation so that the insulation is melt and cut as it is forced across the wire.

The present invention utilizes a pair of sheaves transversely mounted on opposing sides of the support platform. A conductive wire forms an endless belt positioned around the sheaves. The wire is responsive to the angular rotation of the drive sheave. At least one of the sheaves is vertically adjustable in order to set a desired cutting angle.

A power source is connected to the wire in order to heat the wire. The current flowing through the wire is controlled such that the wire is heated to a temperature above the melting point of the foam insulation. The amount of current passing through the wire and the temperature of the wire are displayed on the control panel. The rotating wire is maintained at a generally uniform temperature between the sheaves.

A variable speed motor is connected to the drive sheave which is used to rotate the wire about the sheaves. Once the wire is heated to the desired temperature and is rotating at the desired speed, the sheet of foam insulation is then forced into the rotating wire. The heat and rotation of the wire evenly melts the insulation and tapers the foam insulation sheet as it is forced across the wire.

The rotation of the wire creates forces transverse to the forces being applied to direct the sheet of foam insulation across the wire. Although the rotational action of the wire is not a pure cutting action, the combination of the uniformly heated wire melting the insulation and the rotational movement of the wire cutting the insulation increases the speed at which a sheet of foam insulation can be tapered.

The primary objects of the present invention are to increase the speed at which insulation can be tapered, and to minimize the number of wire breaks. The present invention includes a heated wire which is continuously rotated between two sheaves. Such a configuration maintains a generally uniform temperature in the wire across the transverse section of the foam insulation. The heated wire for tapering equipment is continuously rotated such that the uniform temperature and rotational action of the wire increase the speed at which an individual foam insulation sheet is tapered. The uniform wire temperature and the transverse forces created by the rotating action of the wire result in an quick and even cutting path across the foam insulation.

An object of the present invention is to increase the life of the wire and to minimize breaks in the wire during production operations. Wire breaks result in additional expense and lost production time caused by wire replacement in the tapering equipment.

An additional object of the present invention is to provide a tapering apparatus in which the temperature of the wire, the rotational speed of the wire, and the positioning angle of the wire can be adjusted for optimum tapering operations. The heated, rotating wire generally maintains a uniform temperature across the length of the wire in contact with the insulation thereby resulting in an even cutting path. The wire is maintained at a temperature above the melting point of the insulation.

A further object of the present invention is to provide a means for adjusting the cutting angle of the wire. Vertical adjustment means at each end of the wire facilitate the set up of the tapering apparatus.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
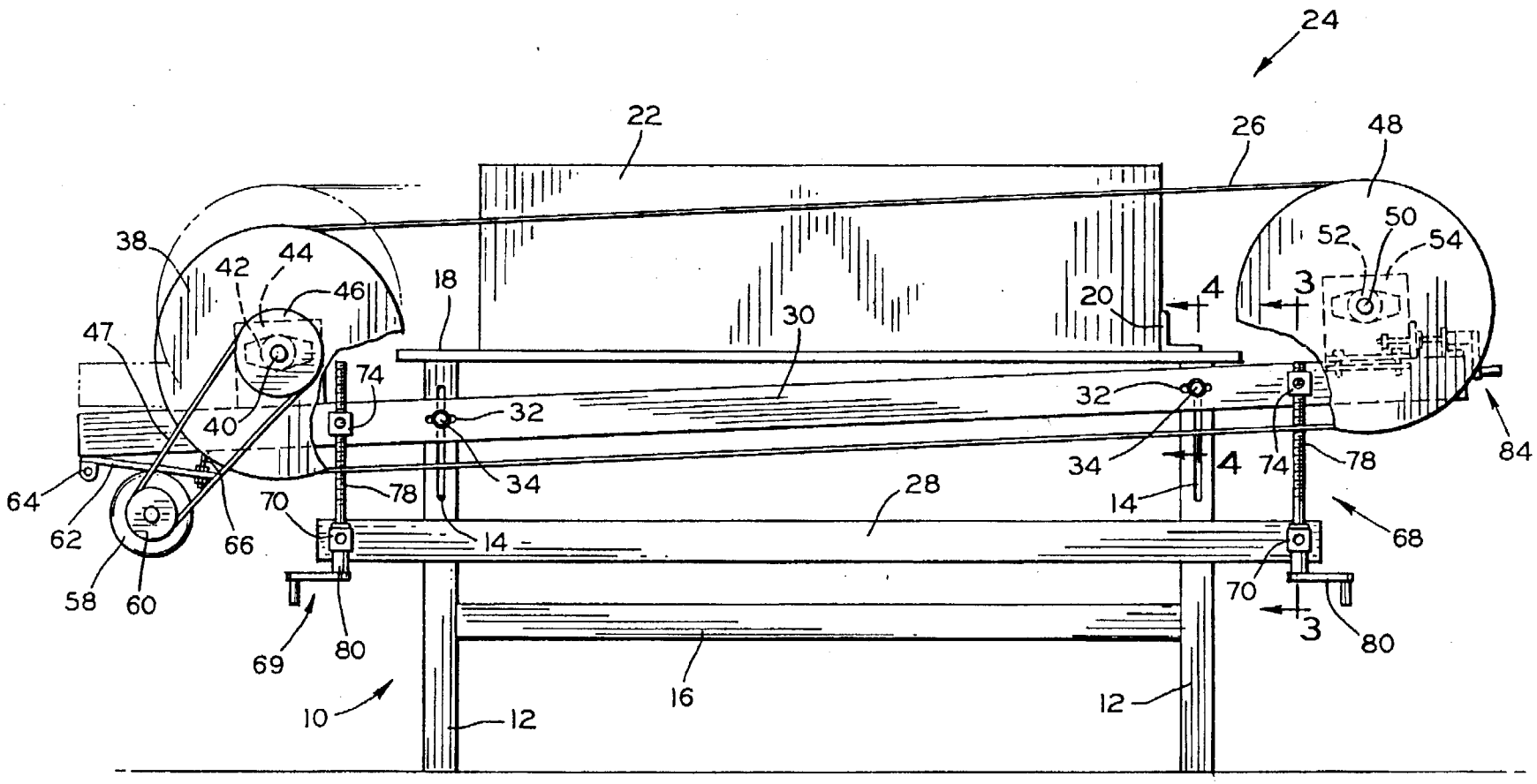
FIG. 1 is a front elevational view of a support platform with the foam tapering apparatus attached according to this invention.
Figure 2:
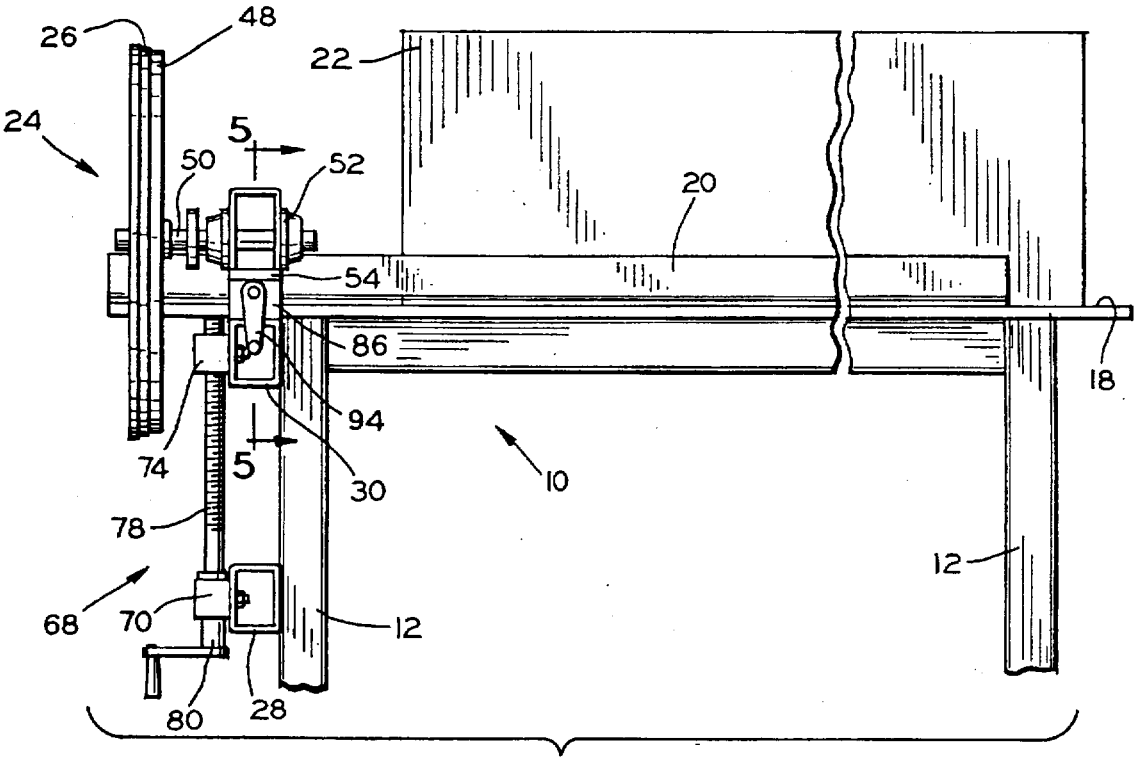
FIG. 2 is a side elevational view of the support platform, the foam insulation, and the tapering apparatus according to the present invention.

Referring now more particularly to the drawings, there is illustrated in FIGS. 1–2 a table platform 10 for holding a sheet of foam insulation 22 and the tapering apparatus 24 of the present invention. The table platform 10 is a rigid structure suitable for supporting the tapering apparatus 24 on lower and upper support members 28, 30. The cutting wire 26 of the tapering apparatus 24 is secured on rotatable sheaves 38, 48 at opposite ends of the adjustable upper support member 30.

The sheets of foam insulation 22 are generally rigid, extruded polystyrene or expanded polystyrene. However, other formed sheets, such as urethane foams or cellular glass, are suitable for use with the present invention.

A flat horizontal surface 18 is used to directly support the sheet of foam insulation 22. A longitudinal guide 20 is positioned along the flat surface 18 at one edge of the platform 10. The guide 20 is generally an angle iron forming a straight edge for positioning the sheet of foam insulation 22 and to limit lateral movement during the tapering operation.

The table platform 10 has two or more pairs of vertical legs 12 with cross brace members 16. The tapering apparatus 24 is mounted on a pair of legs 12 at one end or at the middle of the platform 10. The size of the platform 10 and the positioning of the tapering apparatus 24 can be selected to provide the appropriate support for the insulation 22 during the tapering operation. FIG. 2 shows the tapering apparatus 24 at the end of the table 10. The surface 18 could be extended on the opposite side of the tapering apparatus 24, or a separate surface or stacking means could be place adjacent the tapering apparatus 24 to receive the insulation sheet 22 after the tapering operation.

The pair of vertical legs 12 selected for mounting the tapering apparatus 24 is provided with lower and upper support members 28, 30 extending between the legs 12. An elongated vertical groove 14 extends through each of the two legs 12. The length of the grooves 14 facilitates the adjustable positioning of the upper support member 30 in relationship to the horizontal surface 18 of the platform 10. The upper support member 30 includes horizontal grooves 32 through which the upper member 30 is attached to the vertical legs 12. A bolt 34 passes through each of the grooves 32 on the upper support member 30 and through the corresponding groove 14 of the vertical legs 12. A nut 36 is used to secure the bolt 34.

The vertical grooves 14 and the horizontal grooves 32 are sized for the positioning and adjustment of the upper support member 30 at the desired angle. The grooves 14, 32 allow independent adjustment at either end of the upper support member 30.

The wire 26 used to melt the insulation 22 is formed as an endless belt positioned around the sheaves 38, 48. The wire 26 sits in the grooves of the sheaves 38, 48 and is responsive to the rotation of the drive sheave 38. The preferred material for the wire 26 is either nickel or inconel (an alloy of approximately 80% nickel, 14% chromium, and 6% iron). However, other conductive wires capable of sustaining temperatures above the melting point of the foam insulation 22 are suitable. The lower segment of the wire may be covered by an insulated housing to prevent heat loss as the wire 26 is being rotated.

The wire 26 is of a planar construction with a width of 0.25 to 1.00 inches and a thickness of 0.025 to 0.10 inches. The leading edge of the wire 26 provides a cutting type action in addition to the melting action caused by the heating of the wire 26. The combination of the melting and cutting reduces the tapering time by over 50% when compared to a heated wire without any rotational action.

The sheaves 38, 48 are aligned on opposite ends of the upper support member 30. A pulley wheel with an outer groove for acceptance of the wire 26 may be used to form sheaves 38, 48 The sheaves 38, 48 move in direct relationship to the vertical adjustments to the upper support member 30, and thereby vary their respective vertical positions. The angle of the wire 26 relative to the sheet of foam insulation 22 is adjusted through vertical adjusting mechanisms 68, 69.

Figure 3:
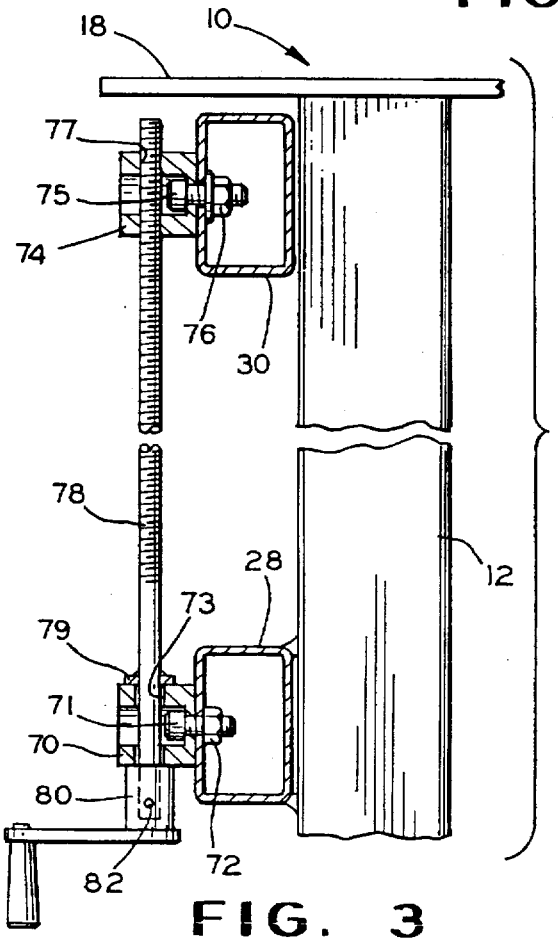
FIG. 3 is a side view of the vertical adjustment mechanism suitable for use in practicing the present invention.
Figure 4:
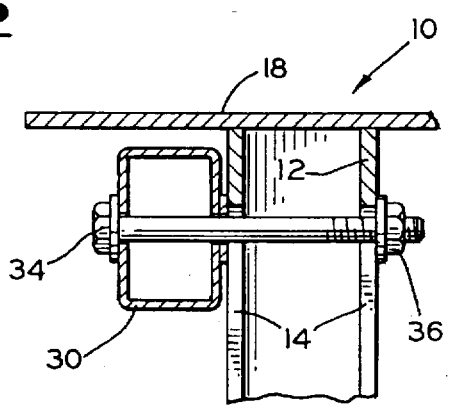
FIG. 4 is a side view of the connecting mechanism to allow the vertical adjustment of the sheaves.

The vertical adjustment mechanisms 68, 69 are fastened between the support members 28, 30 (FIGS. 3–4). The lower support member 28 is attached horizontally to the vertical legs 12 and does not move. The vertical adjustment mechanisms 68, 69 are used to move the upper support member 30 to a specific angle, which determines the corresponding angle of the wire 26 for obtaining the taper on the insulation 22.

The adjustment mechanism 68 includes two mounting brackets 70, 74 and an adjusting rod 78. A first bracket 70 serves is bolted onto the lower support member 28 by bolt 71 and nut 72. A second bracket 74 is attached to the upper support member 30 by bolt 75 and nut 76. The first mounting bracket 70 has an aperture 73 extending through the entire vertical section of the bracket 70. The aperture 73 is sized to accept the smooth end of rod 78. The threaded end of the rod 78 is inserted through a threaded aperture 77 in the second bracket 74. The lower end of the rod extends through the mounting bracket 70 and has a crank handle 80 attached with a set screw 82. The rod 78 is secured in the first mounting bracket 70 by a mounting bearing 79. The vertical adjustment mechanism 69 attached to the opposing side is structurally the same as the described vertical adjustment mechanism 68.

The wire 26 is continuously driven about sheaves 38, 48. A variable speed drive system is used to rotate sheave 38. The motor 58 may be directly coupled to the sheave 38 or may utilize a belt drive configuration (FIG. 1). The motor 58 may be an alternating current motor with a variable frequency controller. A direct current motor with the appropriate variable speed controller is also acceptable for the present invention.

The drive sheave 38 includes a shaft 40 extending through a bearing housing 42 and mounting plate 44 which is mounted on the upper support member 30. The drive sheave 38 has an integral drive pulley 46 connected by belt 47 to drive pulley 60 on motor 58. The motor 58 is mounted onto a mounting plate 62. The mounting plate 62 is connected to the end of the upper support member 30 by a hinge 64. A tensioning bolt 66 is positioned at the opposing end of the mounting plate 62. The tensioning bolt 66 facilitates the mounting of the belt 47 around the pulleys 46, 60 and the subsequent tensioning of the belt 47.

A horizontal adjusting mechanism 84 is mounted on the upper support member 30 at sheave 48. The sheave 48 is mounted on a shaft 50 which extends through a bearing housing 52. The bearing housing 52 has a mounting plate 54 which is then attached to the upper support member 30.

Figure 5:
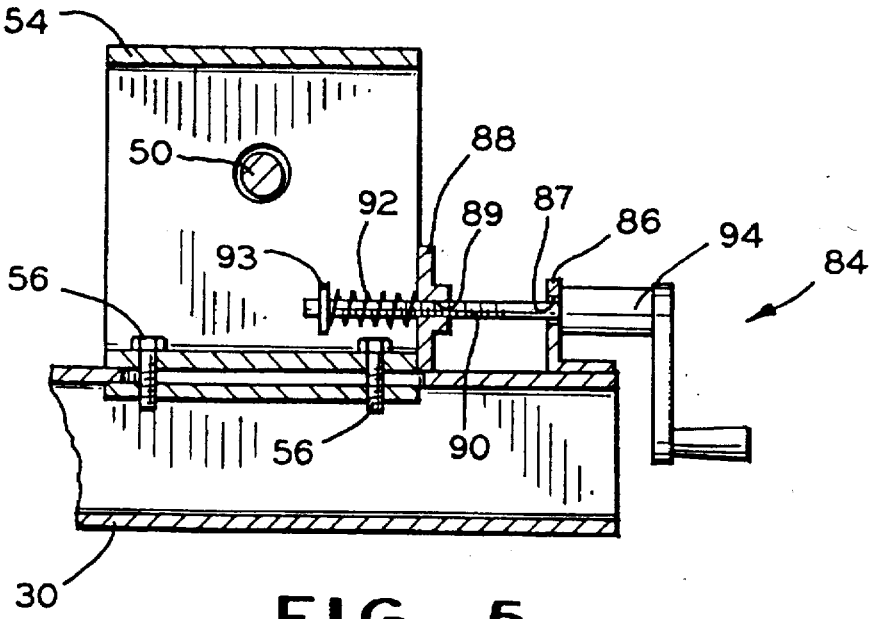
FIG. 5 is an enlarged front view of the horizontal adjusting mechanism.

The horizontal adjusting mechanism 84, shown in FIG. 5, is attached to the mounting plate 54 for the driven sheave 48. The horizontal adjustment mechanism 84 comprises a fixed mounting bracket 86, a moveable mounting bracket 88, a rod 90 having a threaded section, a compression spring 92, and a hand crank 94. The fixed mounting bracket 86 is attached to the upper support member 30. The mounting bracket 86 has an aperture 87 for supporting the one end of the rod 90. The threaded end of the rod 90 is inserted through the threaded aperture 89 of the moveable mounting bracket 88. The compression spring 92 is positioned on the back side of the mounting bracket 88 and is fixed to the rod by a fixed washer 93. The spring 92 maintains an outward force against mounting bracket 88 which assists in maintaining the horizontal position of the sheave 48. The hand crank 94 is connected to the opposing end of the rod 90 by a set screw. The mounting plate 54 of the sheave 48 is secured by two bolts 56. The bolts 56 are in grooved slots (not shown) to allow the horizontal adjustment of the sheave 48. When the bolts 56 are loosened the adjustment mechanism 84 is used to move the sheave 48 in the desired direction to apply the appropriate tension to the wire 26.

Figure 6:
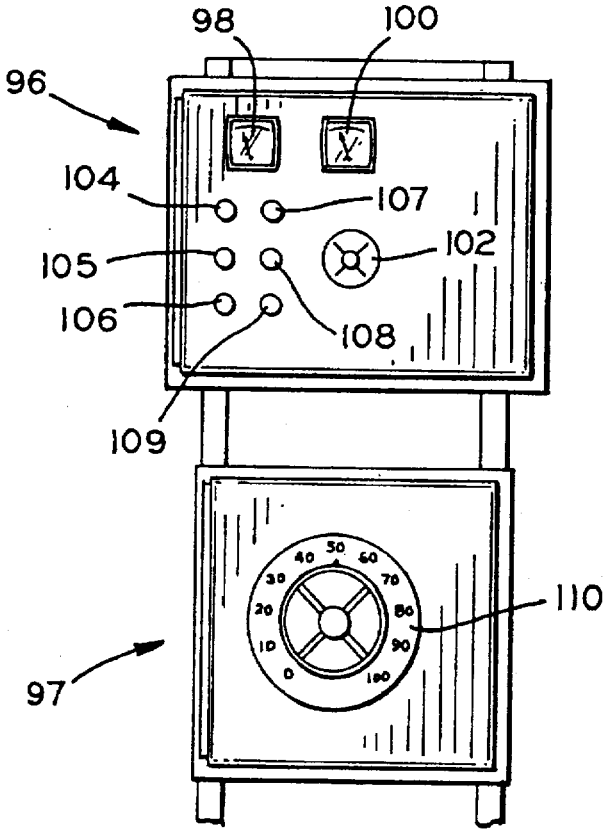
FIG. 6 is a front elevational view of the control panel used in practicing the present invention.
Figure 7:
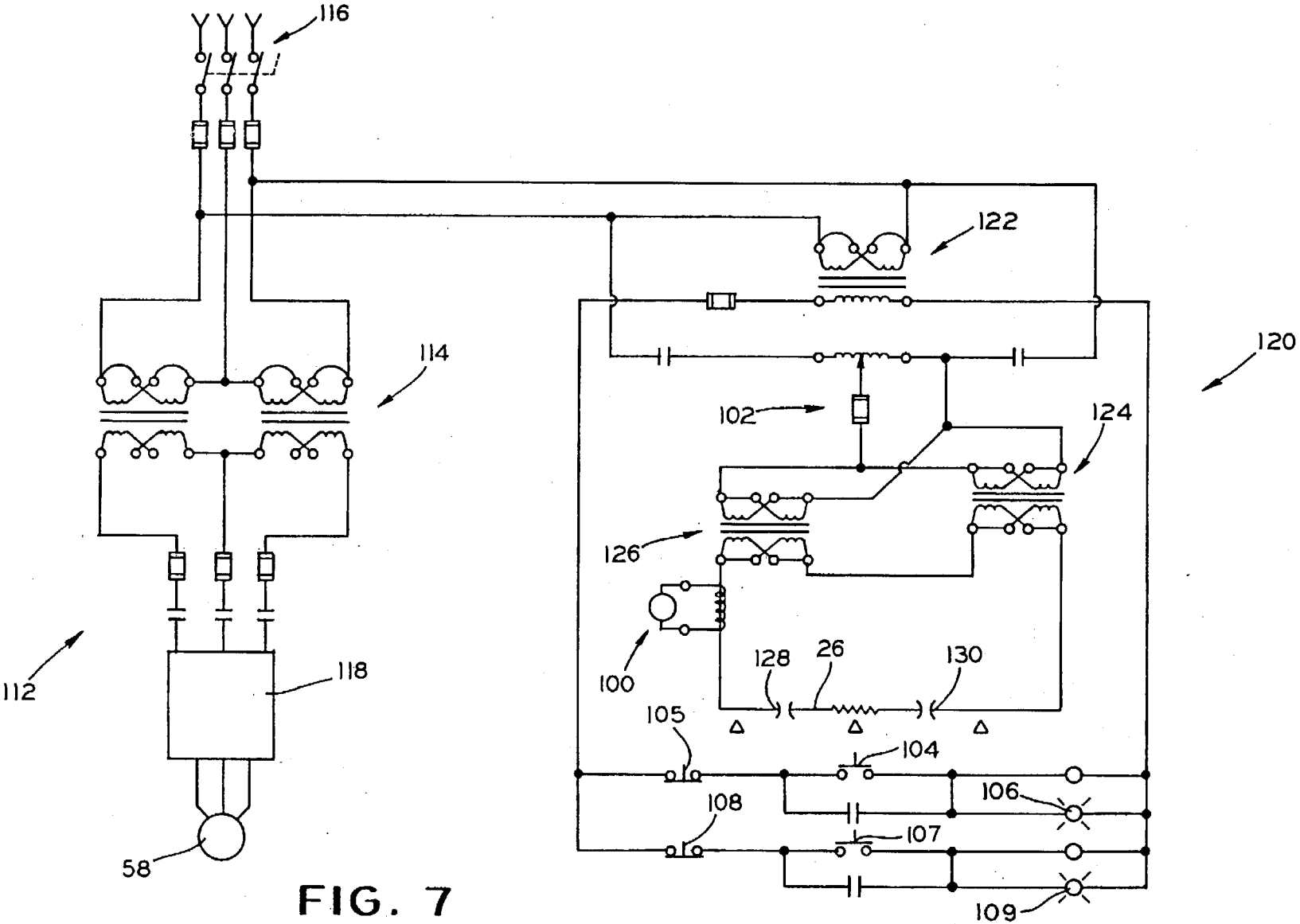
FIG. 7 is an electrical schematic for controlling the present invention.

The electrical system for the tapering apparatus 24 is shown in FIGS. 6–7. The wire 26 is heated to a temperature above the melting point of the insulation 22 by applying a current through the wire 26 between the two sheaves 38, 48. Electrical power is also required for the variable speed drive motor 58.

A control panel 96 and a motor drive panel 97 may be mounted at a convenient location on the platform 10 or on a free standing unit. The two panels could be combined into a single panel for mounting the control components and the variable speed drive controls.

The front face of the control panel 96 includes a number of control devices. Start pushbutton 104, stop pushbutton 105, and indicating light 106 are used to close and open a contactor for starting and stopping the current flowing through the sheaves 38, 48 to the wire 26. A rheostat 102 or other variable resistance device varies the current flowing through the wire 26. Start pushbutton 107, stop pushbutton 108, and indicating light 109 are used to close and open a contactor for starting and stopping the motor 58.

The control panel 96 includes a temperature indicator 98 and an ammeter 100. The ammeter 100 measures and displays the amount of current flowing through the wire 26, the flow of current heating and maintaining the wire at a constant temperature. Because the wire must be heated to a temperature for melting the insulation, it is preferable to have a temperature reading displayed in indicator 98. The temperature of the wire 26 may be measured by an infrared temperature measuring system or a thermistor (not shown) mounted in the groove of the sheaves 38, 48. The temperature may also be calculated by a microprocessor with RAM storage (not shown) for receiving, processing, calculating, storing and transmitting current flow and temperature data.

The motor drive panel 97 contains the three phase variable speed motor control system 112 for the motor 58. The rotary control switch 110 on the front of the panel 97 is used to vary the speed of the motor 58, which controls the corresponding speed of the rotating wire 26.

The power system is typically a three phase, 240 volt system, but a single phase power system motor may also be utilized. A main disconnect switch 116 with appropriate circuit protective features controls power distribution to control panel 96 and drive panel 97. Three phase power is provided to the variable speed motor control system 112 in motor drive panel 97. A single phase power line is pulled from the incoming three phase system to supply power to the single phase control system 120 in control panel 96.

The three phase variable speed motor control system 112 includes an isolation transformer 114 connected to the main disconnect switch 116. The output from the secondary side of transformer 114 is used to power the variable speed drive controller 118. The rotary control switch 110 used to vary the speed of the motor 58 is mounted on the motor drive panel 97 and is part of the controller 118. The speed of the motor 58 is controlled by the output of the controller 118. The motor 58 and the variable speed drive 118 can be either a direct current drive system or an alternating current, variable frequency drive system.

The single phase power line connected to the single phase control system 120 provides a control voltage to the pushbuttons and control contactors, and provides a low voltage power supply through the sheaves 38, 48 to the wire 26. Control transformer 122 is used to transform the 240 volt power supply to a 12 volt control voltage system.

The single phase 240 volt power supply is also used to supply current to the wire 26 through rheostat 102 and transformers 124, 126. The rheostat 102 varies the resistance and the current supplied to the primary side of transformers 124, 126, which are connected in parallel. The secondary side of transformers 124, 126 are connected in series. The output from the secondary side of transformers 124, 126 is supplied to the wire 26 through the electrical connectors 128, 130 at the sheaves 38, 48.

The sheaves 38, 48 include the electrical connectors 128, 130 which provide for continuous transmission of current through the wire 26. The outer groove and the radial spokes of the sheaves 38, 48 are formed from a conductive material in order to transmit the electrical power to the wire 26. The spokes are typically insulated to minimize overheating of the sheaves 38, 48 as power is transmitted to the wire 26.

The output voltage from the transformers 124, 126 is low voltage with a nominal output of 12, 16, 24 or 32 volts. The current carried in the wire 26 can range up to 200 amps without significant overheating problems. The wire 26 is designed to withstand the temperatures needed to melt the insulation 22. Overheating the wire 26 weakens the wire and can lead to premature wire failure or burnt insulation.

The optimum operating conditions are obtained by adjusting the current to achieve a temperature above the melting point of the insulation 22, and by adjusting the speed of the motor 58 to obtain a wire speed such that the wire 26 maintains a smooth cut as the wire 26 rotates. If the speed is too high, the wire 26 will be choppy with an uneven cut and premature wire failure. By using a combination of wire temperature and rotary action, the time required to taper a piece of insulation 22 can be reduced significantly.

Having set forth a description of the structure of the present invention, the use and function of the rotary foam cutter may now be described with particular reference to FIGS. 1 and 6. The sheet of foam insulation 22 is placed onto the table platform 10 and against the longitudinal guide 20. The appropriate vertical dimensions on each side of the sheet are determined based upon the required slope for the application of the insulation onto a roof.

The vertical adjustment mechanisms 68, 69 are then utilized to move the wire to the required vertical dimension on each side of the sheet of foam insulation 22. The bolts 34 are loosened enough to allow the upper support member 30 to move freely within the grooves 14 of the vertical leg 12. The hand cranks 80 on the mechanism 68, 69 turn the threaded rod 78 to move bracket 74 in either an upward or downward vertical position. The bracket 74 is fixed to the upper support member 30 so that the force either raises or lower the upper support member 30, which includes sheaves 38, 48 and the wire 26. Upon selection of the desired slope, the bolts 34 are tightened to secure the upper support member 30.

After setting the desired vertical dimension, the horizontal dimension of the driven sheave 48 is adjusted in order to set the proper tension on the wire 26. The horizontal adjustment mechanism 84 repositions the driven sheave 48 to remove any slack in the wire 26. The bolts 56 of mounting plate are loosened to allow the movement of the sheave 48. The rotation of the rod 90 forces the mounting plate 54 in the desired direction to provide the appropriate tension to allow the rotation of the wire 26. The compression spring 92 applies an outward force on the moveable mounting bracket 88 to assist in maintaining the tension on the wire 26. The bolts 56 are tightened after the sheave 48 has been repositioned.

Once the wire 26 is adjusted to the appropriate vertical and horizontal positions, the tapering apparatus 24 is ready to taper the sheet of foam insulation 22. The motor 58 is started by engaging the push button 107 on the control panel 96. The motor 58 rotates the drive sheave 38 which in turn causes the wire 26 to rotate about the two sheaves 38, 48. The desired speed of rotation is selected at the rotary control switch 110 on the motor drive panel 97.

Electrical power is transmitted through rheostat 102 and the electrical connectors 128, 130 to the wire 26 by using the push button 104 on the control panel 96. The current is varied by adjusting the rheostat 102 until the desired temperature is achieved (above the melting point of the sheet of foam insulation). The temperature indicator 98 on the control panel 96 is used to indicate the temperature of the wire. The temperature is generally set for 700 degrees Fahrenheit when tapering the extruded or expanded polystyrene sheets.

The sheet of foam insulation 22 is then forced into the rotating, heated wire 26. The insulation is melted evenly from side to side as the insulation 22 passes across the wire 26. The tapering of the insulation 22 is completed when the entire sheet passes across the wire 26.

The preferred embodiment described above highlights the use of a heated wire which is rotated to maintain a constant temperature, and to achieve a cutting action combined with a melting action. Such features result in a decrease in the time needed to taper a piece of insulation. The preferred embodiment describes a low-cost tapering apparatus 24 which could be used by the vast majority of roofing companies.

Additional modifications and feature may be added to achieve various economies. A drive system can be attached to the table platform 10 to mechanically force the sheet of insulation across the wire 26. The tapering apparatus 24 is suitably mounted on other supporting structures that allow for the tapering of sheets of foam insulation. A conveyor system with automated handling of the insulation could be used for high volume processing of insulations sheets.

The tapering apparatus could also be provided with additional modifications and automation features, similar to machine tool applications. A computerized numerical control system or a programmable controller could be included in the control system. The desired tapering action is designed on a computerized design system, and then the design data is transferred to the computerized control system of the tapering apparatus such that the computer transmits control signals for the various production parameters to produce the desired taper. Electric or hydraulic drives could be used for vertical and horizontal positioning. The overall design of a roof may be designed on a computer with software to automatically calculate the number of pieces of insulation require for the roofing project and the taper for all of the pieces. Although the additional cost for the hardware and software to computerize the process is significant, such costs could be justified for major roofing contractors with high volume operations. The control panels 96, 97 could easily accommodate the hardware necessary to automate the setup and operation of the tapering apparatus 24.

In accordance with the provisions of the patent statutes, the present invention has been described in what is considered to represent its preferred embodiment. However, it should be noted that the invention can be practiced otherwise than as specifically illustrated and described without departing from its spirit and scope.

What is claimed is:

1. A tapering apparatus mounted on a horizontal support platform for tapering sheets of foam insulation as the sheets are driven across said platform, said tapering apparatus comprising:

(a) a pair of rotatable sheaves positioned adjacent to opposing side edges of a horizontal support platform having an upper surface and a lower surface;

(b) a conductive wire forming an endless belt rotatably positioned on said sheaves and around the support platform such that a segment of said conductive wire extends in spaced-apart relationship across the upper surface and a second segment of said conductive wire extends in spaced-apart relationship across the lower surface of the horizontal support platform;

(c) adjustment means for positioning one of said pair of sheaves such that a slope of the conductive wire in relation to the upper surface of the horizontal support platform is adjustable;

(d) an adjustable power supply connected to said pair of rotatable sheaves for supplying a current through said wire, said adjustable power supply including a current control means for varying the current through said wire to uniformly heat said wire to a temperature above the melting temperature of the foam insulation; and (e) an adjustable speed motor rotatably connected to one of said sheaves for rotating said wire about said sheaves, said adjustable speed motor including a speed control means for controlling the speed of the wire as it rotates about said pair of sheaves, whereby a sheet of insulation positioned on the upper surface of the horizontal platform is tapered as the heated wire rotatably engages the sheet of insulation being forced across the heated wire.

2. The tapering apparatus according to claim 1, wherein said adjustment means includes a vertical adjustment mechanism connected to each of the sheaves to vary a slope and a height of said wire in relation to the upper surface of the horizontal platform.

3. The tapering apparatus according to claim 1, including a horizontal adjustment means connected to one of said sheaves for horizontally adjusting spacing between said sheaves in order to tension said conductive wire.

4. The tapering apparatus according to claim 1, wherein said wire is selected from the group consisting of nickel or inconel.

5. The tapering apparatus according to claim 1, wherein the speed control means of said adjustable speed motor includes a controller for selectively varying the speed of said motor.

6. The tapering apparatus according to claim 5, wherein said adjustable speed motor includes an alternating current motor and a variable frequency controller.

7. The tapering apparatus according to claim 5, wherein said adjustable speed motor includes a direct current motor and controller.

8. The tapering apparatus according to claim 1, wherein said adjustable power supply includes an ammeter for monitoring the current flowing through said conductive wire.

9. The tapering apparatus according to claim 1, including a programmable controller connected to said adjustment means for positioning said wire, to the current control means for controlling the current flowing through said wire, and to the speed control means for controlling the speed of said wire moving about said rotatable sheaves.

10. The tapering apparatus according to claim 1, including a longitudinal guide secure to the upper surface of the horizontal platform, said longitudinal guide engaging an edge of the sheet of insulation to prevent lateral movement of the sheet of insulation.

11. The tapering apparatus according to claim 1, including a means for sensing temperature connected to the current control means of said adjustable power supply.

12. A tapering apparatus mounted on a horizontal support platform for tapering sheets of foam insulation as the sheets are driven across said platform, said tapering apparatus comprising:

(a) a pair of rotatable sheaves positioned adjacent to opposing side edges of a horizontal support platform having an upper surface and a lower surface;

(b) a conductive wire forming an endless belt rotatably positioned on said sheaves and around the support platform such that a segment of said conductive wire extends in spaced-apart relationship across the upper surface and a second segment of said conductive wire extends in spaced-apart relationship across the lower surface of the horizontal support platform;

(c) adjustment means for vertically and horizontally positioning said pair of sheaves such that a height and a slope of the conductive wire in relation to the upper surface of the horizontal support platform is adjustable;

(d) an adjustable power supply connected to said pair of rotatable sheaves for supplying a current through said wire, said adjustable power supply including a variable resistance controller for varying the current through said wire to uniformly heat said wire to a temperature above the melting temperature of the foam insulation; and (e) an adjustable speed motor rotatably connected to one of said sheaves for rotating said wire about said sheaves, said adjustable speed motor including a motor controller for controlling a speed of the motor and a resultant speed of said wire as said wire rotates about said pair of sheaves, whereby a sheet of insulation positioned on the upper surface of the horizontal support platform is tapered as the heated wire rotatably engages the sheet of insulation being forced across the heated wire.

13. The tapering apparatus according to claim 12, including a programmable controller connected to said adjustment means for positioning said wire, to the variable resistance controller for controlling the current flowing through said wire, and to the motor controller for controlling the speed of said motor and the resultant rotational speed of said wire.

* * * * *